US010643419B2

(12) United States Patent
Niizuma et al.

(10) Patent No.: US 10,643,419 B2
(45) Date of Patent: May 5, 2020

(54) COIN PROCESSING APPARATUS

(71) Applicant: FUJI ELECTRIC CO., LTD., Kawasaki (JP)

(72) Inventors: Nobuyuki Niizuma, Yokkaichi (JP); Tomohiko Kimura, Yokkaichi (JP); Yoshimasa Inoue, Yokkaichi (JP)

(73) Assignee: FUJI ELECTRIC CO., LTD., Kawasaki (JP)

( * ) Notice: Subject to any disclaimer, the term of this patent is extended or adjusted under 35 U.S.C. 154(b) by 0 days.

(21) Appl. No.: 15/415,126

(22) Filed: Jan. 25, 2017

(65) Prior Publication Data

US 2017/0221294 A1 Aug. 3, 2017

(30) Foreign Application Priority Data

Jan. 29, 2016 (JP) ..... 2016-015237

(51) Int. Cl.
*G07D 11/237* (2019.01)
*G07D 1/00* (2006.01)
(Continued)

(52) U.S. Cl.
CPC ..... *G07D 11/237* (2019.01); *G07D 1/00* (2013.01); *G07D 1/06* (2013.01); *G07D 5/00* (2013.01);
(Continued)

(58) Field of Classification Search
CPC ..... G07D 3/04; G07D 9/02; G07D 9/008; G07D 11/0039; G07D 11/0048;
(Continued)

(56) References Cited

U.S. PATENT DOCUMENTS 4,167,949 A * 9/1979 Hashimoto ..... G07D 3/16 453/12
4,678,994 A * 7/1987 Davies ..... G01V 3/102 194/317
(Continued)

FOREIGN PATENT DOCUMENTS

CN 101441784 5/2011
CN 102693593 9/2012
(Continued)

OTHER PUBLICATIONS www.dictionary.com entry for the term "stay" as of Sep. 28, 2017.*
(Continued)

*Primary Examiner* — Jeffrey A Shapiro

(57) ABSTRACT

A coin processing apparatus configured to: cause a coin output conveying unit to collectively convey coins taken out for each denomination from a plurality of coin containers where the coins are housed in the respective coin containers for each denomination; and dispense the conveyed coins from a coin output port through a coin output shoot unit, the coin processing apparatus includes: a coin stay detecting sensor configured to detect a coin stay on a shoot face of the coin output shoot unit; a reporting unit configured to perform report output for abnormality; and a controller configured to cause the reporting unit to perform report output for coin stay abnormality in the coin output shoot unit when the coin stay detecting sensor detects the coin stay.

5 Claims, 8 Drawing Sheets

(51) Int. Cl.

| | |
|---|---|
| ***G07D 1/06*** | (2006.01) |
| ***G07D 5/08*** | (2006.01) |
| ***G07D 5/00*** | (2006.01) |
| ***G07D 11/22*** | (2019.01) |
| ***G07D 11/20*** | (2019.01) |

(52) U.S. Cl.
CPC ..... *G07D 5/08* (2013.01); *G07D 11/20* (2019.01); *G07D 11/22* (2019.01)

(58) Field of Classification Search
CPC ..... G07D 2201/00; G07D 1/00; G07D 1/06; G07D 5/00; G07D 5/08; G07D 11/237; G07D 11/235; G07D 11/20; G07D 11/22; G07F 1/04; G07F 1/046; G07F 11/20; G07F 11/22; G07F 11/30
USPC ..... 194/344, 350; 235/379; 453/7, 56; 193/DIG. 1
See application file for complete search history.

(56) References Cited

U.S. PATENT DOCUMENTS

| | | | | | |
|---|---|---|---|---|---|
| 4,733,765 | A * | 3/1988 | Watanabe | G07D 9/00 | 194/206 |
| 5,002,516 | A * | 3/1991 | Watanabe | G07D 9/065 | 453/31 |
| 5,219,059 | A * | 6/1993 | Furuya | G07D 5/08 | 194/200 |
| 5,647,469 | A * | 7/1997 | Yamagishi | G07D 5/08 | 194/200 |
| 5,679,070 | A * | 10/1997 | Ishida | G07D 1/00 | 194/200 |
| 5,913,399 | A * | 6/1999 | Takemoto | G07F 17/32 | 194/200 |
| 6,039,164 | A * | 3/2000 | Waters | G07F 9/06 | 194/206 |
| 6,539,083 | B1 * | 3/2003 | Churchman | G07D 5/08 | 194/316 |
| 2005/0173515 | A1 * | 8/2005 | Sawa | G07D 11/0069 | 235/379 |
| 2007/0029159 | A1 * | 2/2007 | Quattrini | G07D 3/123 | 194/302 |
| 2007/0060033 | A1 * | 3/2007 | Kotani | G07D 9/008 | 453/56 |
| 2007/0170036 | A1 * | 7/2007 | Takeuchi | G07D 5/08 | 194/344 |
| 2009/0127066 | A1 * | 5/2009 | Kaneko | G07D 1/02 | 194/344 |
| 2012/0199438 | A1 | 8/2012 | Taniike | | |
| 2012/0255831 | A1 | 10/2012 | Kaneko | | |
| 2016/0300399 | A1 * | 10/2016 | Matsuno | G07D 9/008 | |

FOREIGN PATENT DOCUMENTS

| | | | |
|---|---|---|---|
| JP | 5-128340 | | 5/1993 |
| JP | 9-91481 | A | 4/1997 |
| JP | 11-96443 | A | 4/1999 |
| JP | 2000-123247 | | 4/2000 |
| JP | 2001-155214 | A | 6/2001 |
| JP | 2010-211445 | | 9/2010 |
| JP | 2014-142877 | A | 8/2014 |

OTHER PUBLICATIONS

Japanese Office Action dated Oct. 23, 2019 in corresponding Japanese Patent Application No. 2016-015237.
Office Action, dated Jan. 7, 2020, in Taiwanese Application No. 106102448 (12 pages).

* cited by examiner

COIN PROCESSING APPARATUS

CROSS-REFERENCE TO RELATED APPLICATION(S)

The present application claims priority to and incorporates by reference the entire contents of Japanese Patent Application No. 2016-015237 filed in Japan on Jan. 29, 2016.

BACKGROUND

1. Technical Field

The disclosure relates to a coin processing apparatus.

2. Related Art

A coin processing apparatus has a function that identifies coins dropped in a coin dropping opening, automatically takes in the coins to the inside of the apparatus, and houses the coins in coin containers provided in accordance with the denominations of coins while dispensing other coins that have been housed in the coin containers to a coin dispensing port as change for a requested amount of money in response to a change dispensing request from, for example, external equipment. The coin processing apparatus includes various types of conveying means for dispensing coins, which may cause a coin stay therein, and the apparatus is configured to detect this coin stay.

For example, Japanese Patent Application Laid-open No. 2000-123247 discloses that a coin stay is detected, during coin dispensing, by sensors disposed on the downstream side of a dispensing stop mechanism, one sensor counting dispensing, for each denomination, while the other sensor identifying the denominations of the coins.

Japanese Patent Application Laid-open No. 5-128340 discloses that, when coins are conveyed sequentially with a plurality of conveying belts connected in series and a coin stay occurs on the downstream side, a conveyance drive on the upstream side of the dispensing stop mechanism is adjusted sequentially, and that the coin stay is detected by a coin stay detecting unit that is provided for each of the connecting units of the conveyance belts.

SUMMARY

Recent years, some auto money changer, including a coin processing apparatus, has been arranged such that a coin dropping opening thereof and a coin output port thereof face a customer and the money changer serves as a self register with which the customer performs a bar code reading for a product and paying or receiving money, or as a semi-self register with which the customer performs only paying or receiving money. For such self register or semi-self register, it is easy to stick a matter hampering coin dispending, on or near the coin output port thereof, and a trouble easily occurs during coin dispensing due to a customer misdemeanor or a child prank. In particular, the coin output shoot unit for causing conveyed coins to run down to the coin output port is apt to suffer this customer misdemeanor or child prank. Once a coin stay is caused by the hampering on coin dispensing, the coin dispending function cannot stably work and the performance of the coin dispensing function rather decreases the efficiency of paying and receiving money.

According to an aspect of the present disclosure, a coin processing apparatus configured to: cause a coin output conveying unit to collectively convey coins taken out for each denomination from a plurality of coin containers where the coins are housed in the respective coin containers for each denomination; and dispense the conveyed coins from a coin output port through a coin output shoot unit is provided. The coin processing apparatus includes: a coin stay detecting sensor configured to detect a coin stay on a shoot face of the coin output shoot unit; a reporting unit configured to perform report output for abnormality; and a controller configured to cause the reporting unit to perform report output for coin stay abnormality in the coin output shoot unit when the coin stay detecting sensor detects the coin stay.

The above and other objects, features, advantages and technical and industrial significance of this disclosure will be better understood by reading the following detailed description of presently preferred embodiments of the disclosure, when considered in connection with the accompanying drawings.

DETAILED DESCRIPTION

The following describes an embodiment according to the disclosure with reference to the accompanying drawings.

A Structure of a Coin Processing Apparatus

Figure 1:
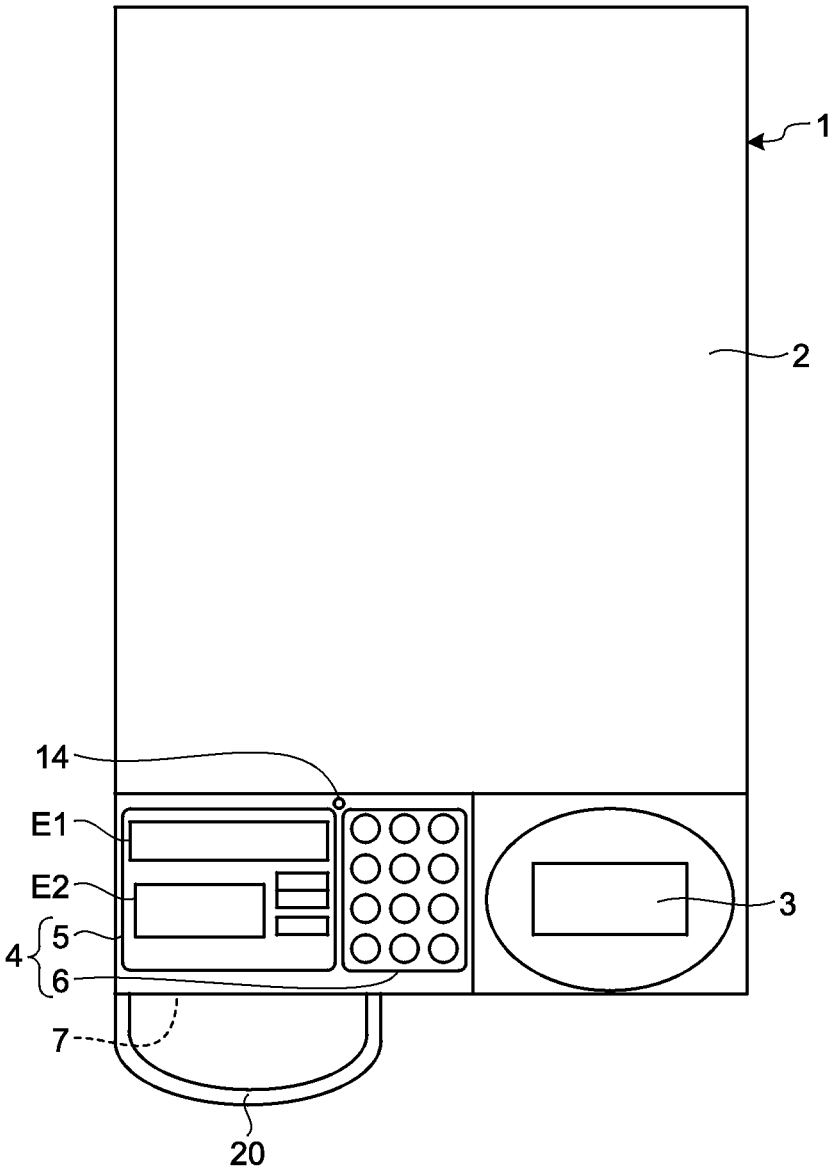
FIG. 1 is a plan view illustrating a structure of a coin processing apparatus according to an embodiment of the disclosure.
Figure 2:
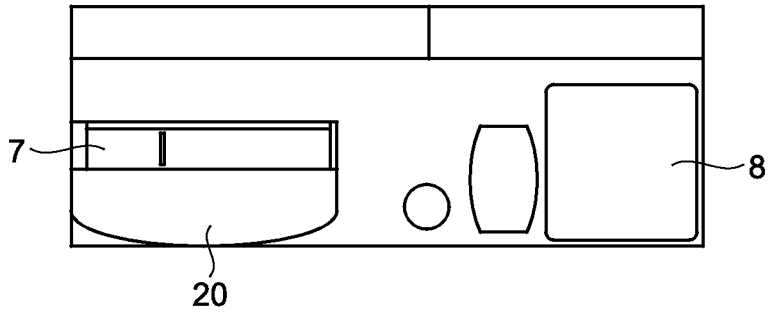
FIG. 2 is a front view of the coin processing apparatus illustrated in FIG. 1.

FIG. 1 is a plan view illustrating a structure of a coin processing apparatus 1 in the embodiment of the disclosure. FIG. 2 is a front view of the coin processing apparatus 1 illustrated in FIG. 1. The coin processing apparatus 1 exemplified herein is used as an auto money changer connected to a POS register device in a shop such as a supermarket or a convenience store. As illustrated in FIGS. 1 and 2, the coin processing apparatus 1 includes a coin dropping opening 3 on the right of the front upper end of a rectangular parallelepiped apparatus body 2, and includes an operation display unit 4 and a buzzer 14 on the left of the front upper end of the apparatus body 2. The operation display unit 4 includes a display unit 5 and an operation unit 6. The display unit 5 includes display areas E1 and E2 on which liquid crystal display is implemented. The apparatus body 2 includes a coin output port 7 on the front left thereof. Coins output from the coin output port 7 are received by a tray 20. The apparatus body 2 includes a coin return port 8 on the front right thereof. It should be noted that the coin processing apparatus 1 is disposed such that the front of the apparatus body 2 thereof faces a customer, thereby serving as a self register with which the customer performs a bar code reading for a product and paying or receiving money, or as a semi-self register with which the customer performs only paying or receiving money.

Operation Overview of the Coin Processing Apparatus

Figure 3:
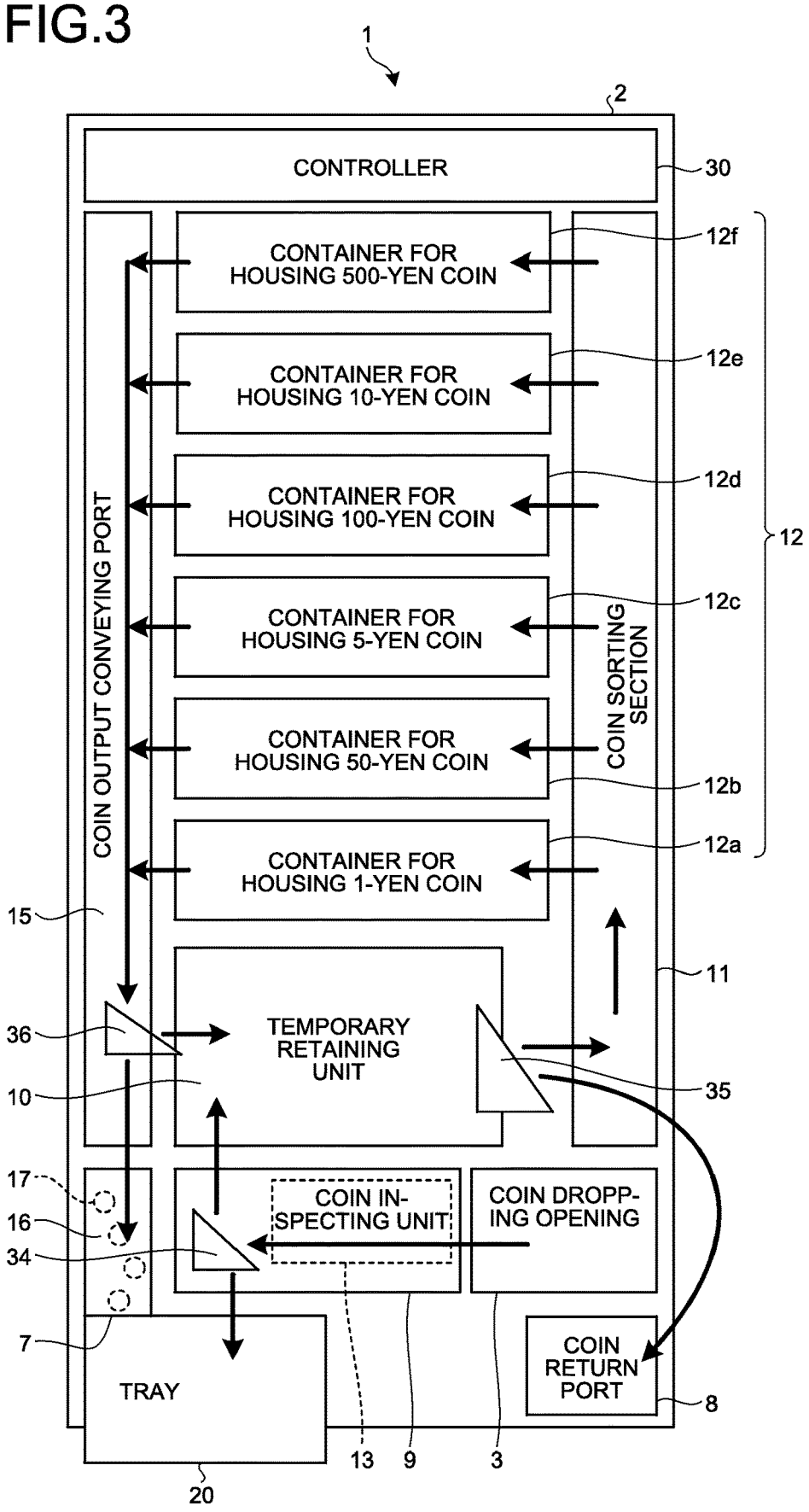
FIG. 3 is a plan view schematically illustrating an internal structure of the coin processing apparatus illustrated in FIG. 1.

The coin dropping opening 3 is an opening from which input coins are taken in to the inside of the apparatus body 2. The coin dropping opening 3 functions as a temporary holding section for temporarily holding money received from a customer. Upon receiving a coin input enable instruction from a host device, such as a POS register device, which is not illustrated, the coin processing apparatus causes the input coin detecting sensor, which is not illustrated, to detect coins input from the coin dropping opening 3, and causes an input coin conveying unit 9 to convey the coins as illustrated in FIG. 3. A coin inspecting unit 13 included in the input coin conveying unit 9 determines whether the coins are true or false and the denomination of the coins. When a conveyed coin is true, it is held in a temporary retaining unit 10. By contrast, when the conveyed coin is false, it is returned to the tray 20 through a switching gate 34 and the coin output port 7. It should be noted that, when a return instruction is sent from the host device or a return lever, which is not illustrated, the coin held in the temporary retaining unit 10 is returned to the coin return port 8 through a switching gate 35.

Thereafter, the coins held in the temporary retaining unit 10 are conveyed through a coin sorting section 11. The coins conveyed through the coin sorting section 11 are housed in coin containers 12 according to denominations. In the embodiment, the apparatus body 2 includes therein six coin containers 12: a 1-yen coin container 12*a*, a 50-yen coin container 12*b*, a 5-yen coin container 12*c*, a 100-yen coin container 12*d*, a 10-yen coin container 12*e*, and a 500-yen coin container 12*f*. The coin containers 12 individually house the input coins for each denomination.

It should be noted that the coins housed in the respective coin containers 12 can be conveyed to the temporary retaining unit 10 through a switching gate 36. The temporary retaining unit 10 also functions as a careful inspection container for re-counting the number of coins housed in the respective coin containers 12 after emptying the respective coin containers 12.

Then, coins the denomination of each of which corresponds to a coin output instruction from the host device are collectively conveyed from the respective coin containers 12 through a coin output conveying unit 15, and dispensed from the coin output port 7 through a coin output shoot unit 16 to the outside of the apparatus body 2.

Structure of a Coin Output Shoot Unit

Figure 4:
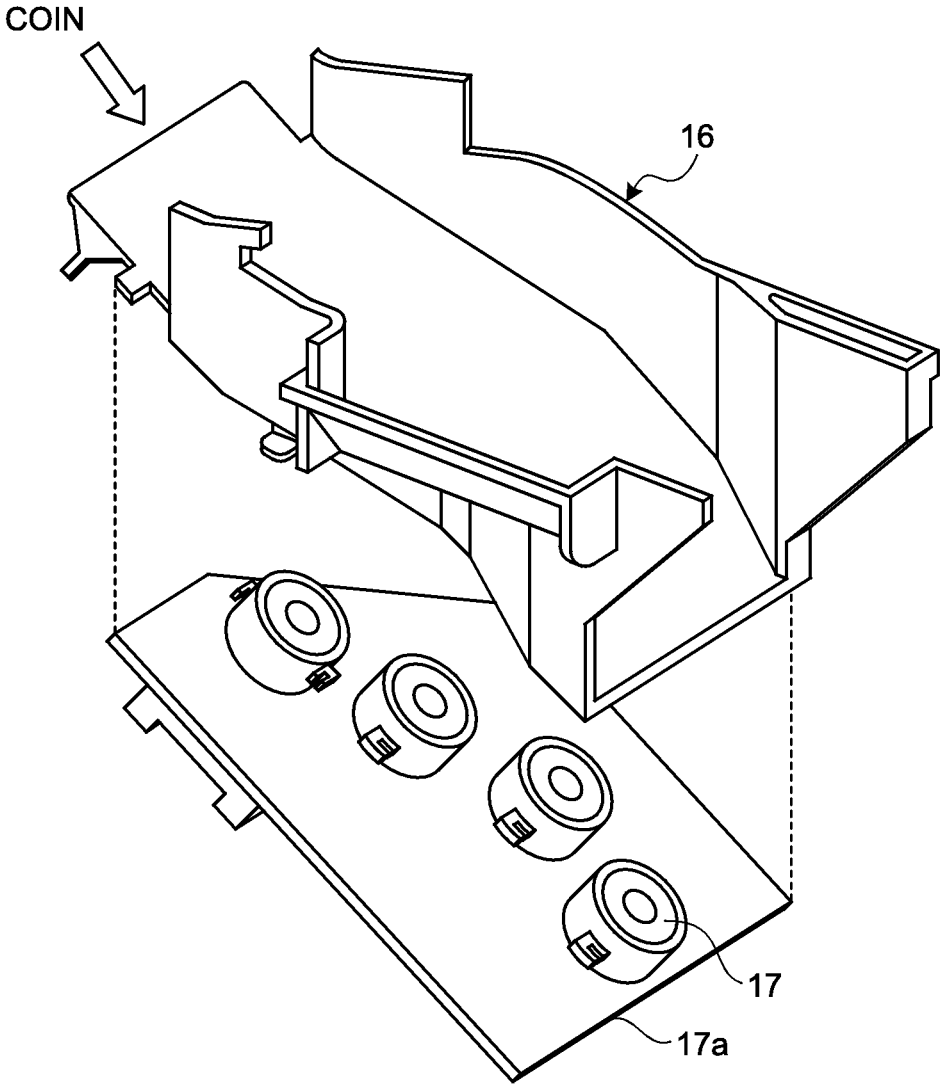
FIG. 4 is an explosive perspective view of a coin output shoot unit.
Figure 5:
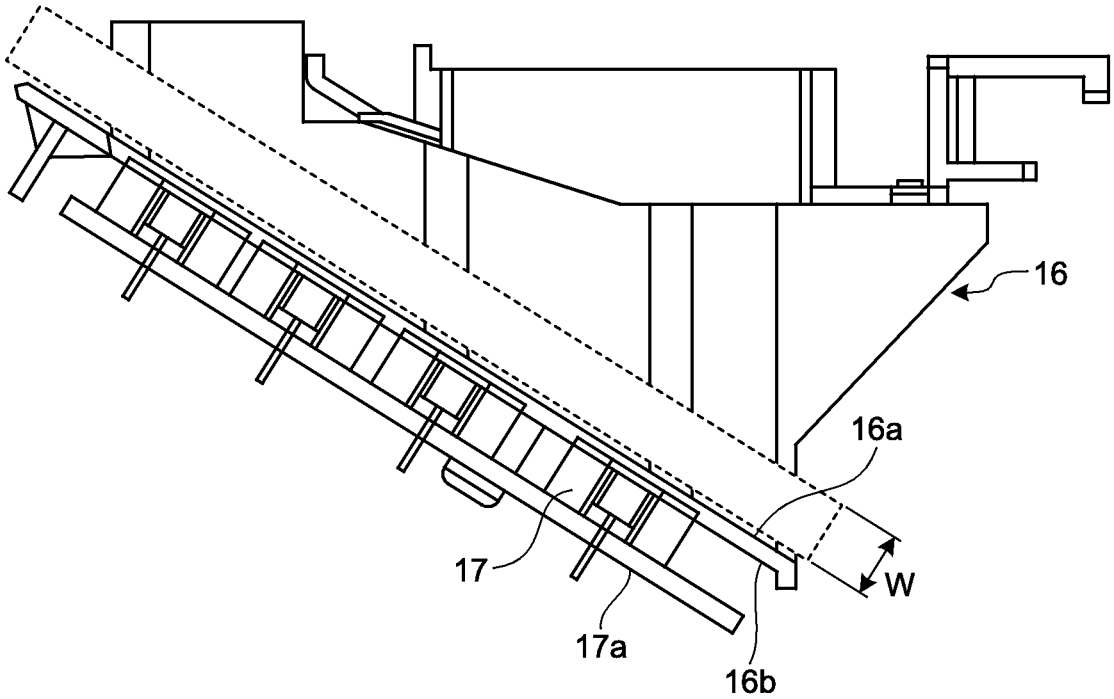
FIG. 5 is a side view of the coin output shoot unit.
Figure 6:
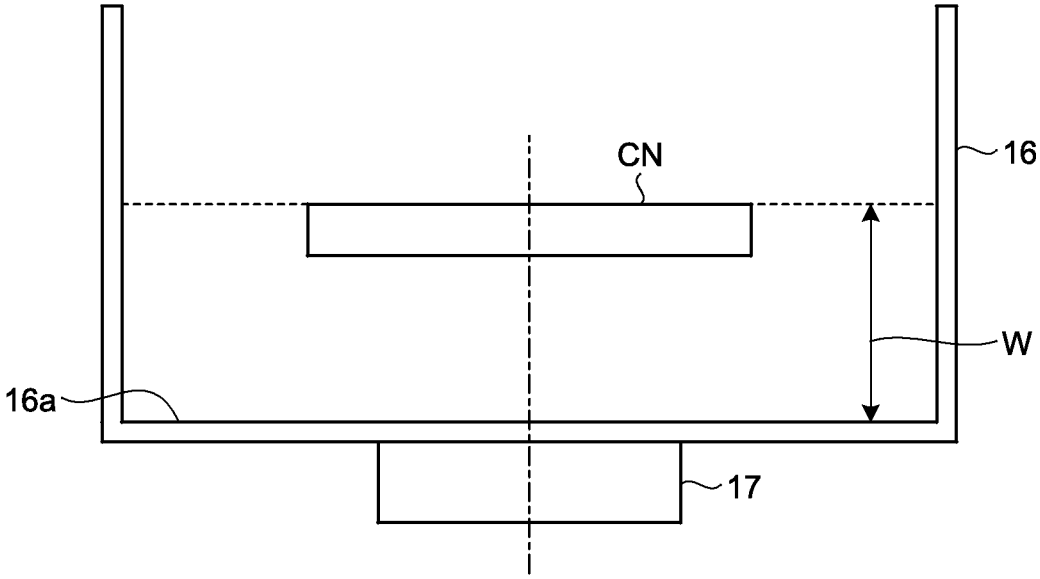
FIG. 6 is a cross-sectional view of the coin output shoot unit.

FIG. 4 is an explosive perspective view illustrating the coin output shoot unit 16. FIG. 5 is a side view of the coin output shoot unit 16. FIG. 6 is a cross-sectional view of the coin output shoot unit 16. As illustrated in FIGS. 4 to 6, the coin output shoot unit 16 includes a tilted shoot face 16*a* with which coins conveyed from the coin output conveying unit 15 are guided to the coin output port 7. A back face 16*b* on the back side of the short face 16*a* is provided with a plurality of coin stay detecting sensors 17 that are mounted on a support panel 17*a*. In the embodiment, the four coin stay detecting sensors 17 are provided on the back face 16*b*. The coin stay detecting sensors 17 each detect a coin stay on the shoot face 16*a*. Each of the coin stay detecting sensors 17 is, for example, a magnetic coil sensor. The denominations of coins to be detected are 1 yen, 5, yen, 10 yen, 50 yen, 100 yen, and 500 yen. The coin stay detecting sensors 17 each have a detection range from the shoot face 16*a* to the height W. Each of the four coin stay detecting sensors 17 does not detect across the full width of the shoot face 16*a* of this detection range, but each sensor is arranged such that it has a detection range over which a 1-yen coin, the diameter of which is smallest of all other denominations of coins, passing through the shoot face 16*a* can be detected in succession on the shoot face 16*a*. As illustrated in FIG. 6, a coin CN passes over the short face 16*a* in a state where the coin CN is disposed in parallel to the shoot face 16*a*. Consequently, as illustrated in FIG. 6, coins CN passing through a range from the shoot face 16*a* to the height W can be detected in succession, and a staying coin CN can be detected. It should be noted that conventionally there used to be no such coin processing apparatus that includes a sensor for detecting a coin stay in the coin output shoot unit 16 on the upstream side that is directly connected to the coin output port 7.

Control System of a Coin Processing Apparatus

Figure 7:
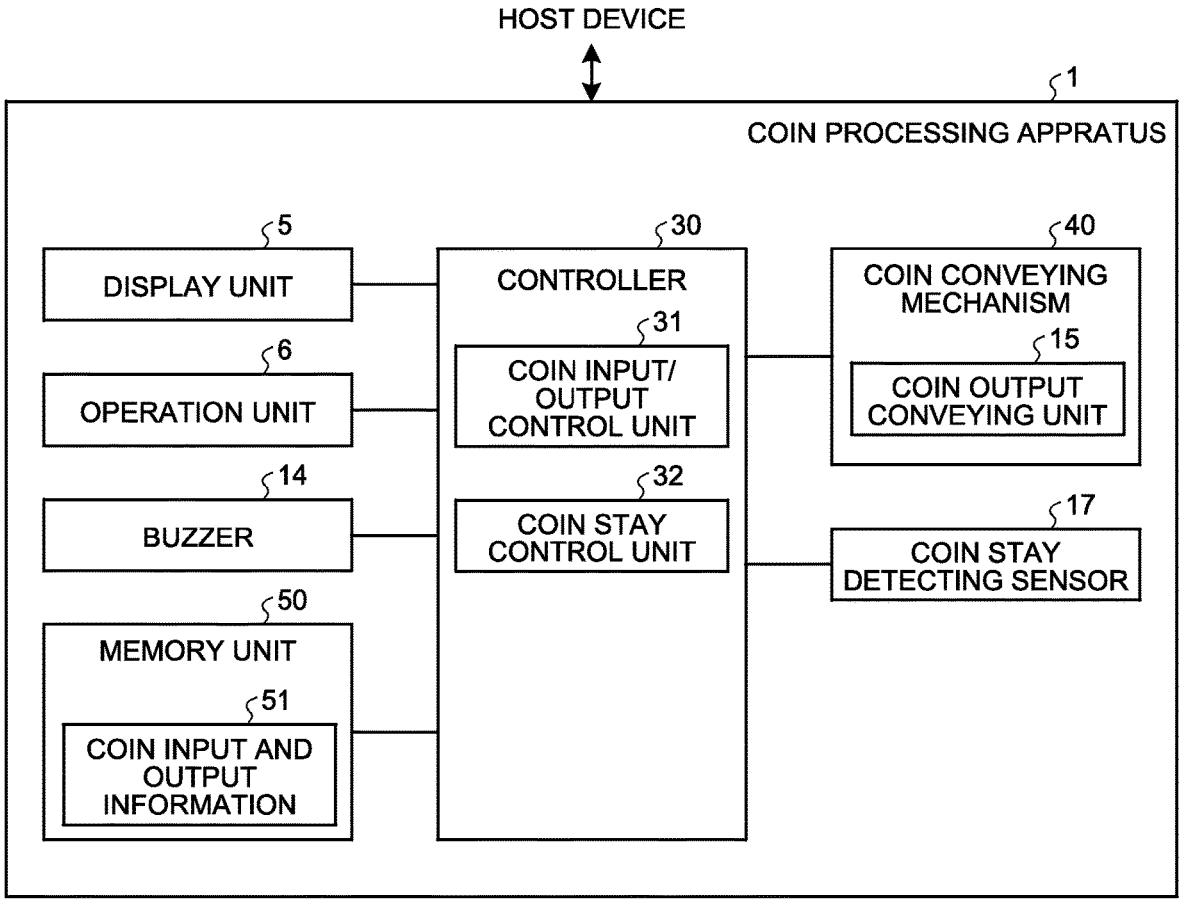
FIG. 7 is a block diagram illustrating a control system of the coin processing apparatus.

FIG. 7 is a block diagram illustrating a control system of the coin processing apparatus 1. As illustrated in FIG. 7, a controller 30 connects to the display unit 5, the operation unit 6, the buzzer 14, a memory unit 50, a coin conveying mechanism 40, and the coin stay detecting sensors 17. The controller 30 also connects to an external host device such as a POS register device. The coin conveying mechanism 40 includes the input coin conveying unit 9, the coin sorting section 11, the coin output conveying unit 15, and the switching gates 34, 35, and 36. It should be noted that the display unit 5 and the buzzer 14 function as reporting units.

The controller 30 is configured to perform, based on programs stored in the memory unit 50 or initial data, display control for the display unit 5, voice output control for the buzzer 14, or drive control for the coin conveying mechanism 40, when receiving an instruction through the operation unit 6, receiving a detection signal from the coin inspecting unit 13, or receiving various types of instruction from the host device. The controller 30 includes a coin input/output control unit 31 and a coin stay control unit 32.

The coin input/output control unit 31 is configured to perform coin input processing according to the coin input enable instruction when a coin is input after the coin input enable instruction is issued from the host device, and perform coin output processing according to the coin output instruction when the coin output instruction is issued from the host device. Furthermore, the coin input/output control unit 31 performs, while executing the above-described coin input processing and coin output processing, processing for storing in the memory unit 50 sequentially, as coin input and output information 51, the contents of the coin input processing and coin output processing that have been already performed. In addition, the coin input/output control unit 31 performs balance management or the like.

Coin Stay Control Processing

Figure 8:
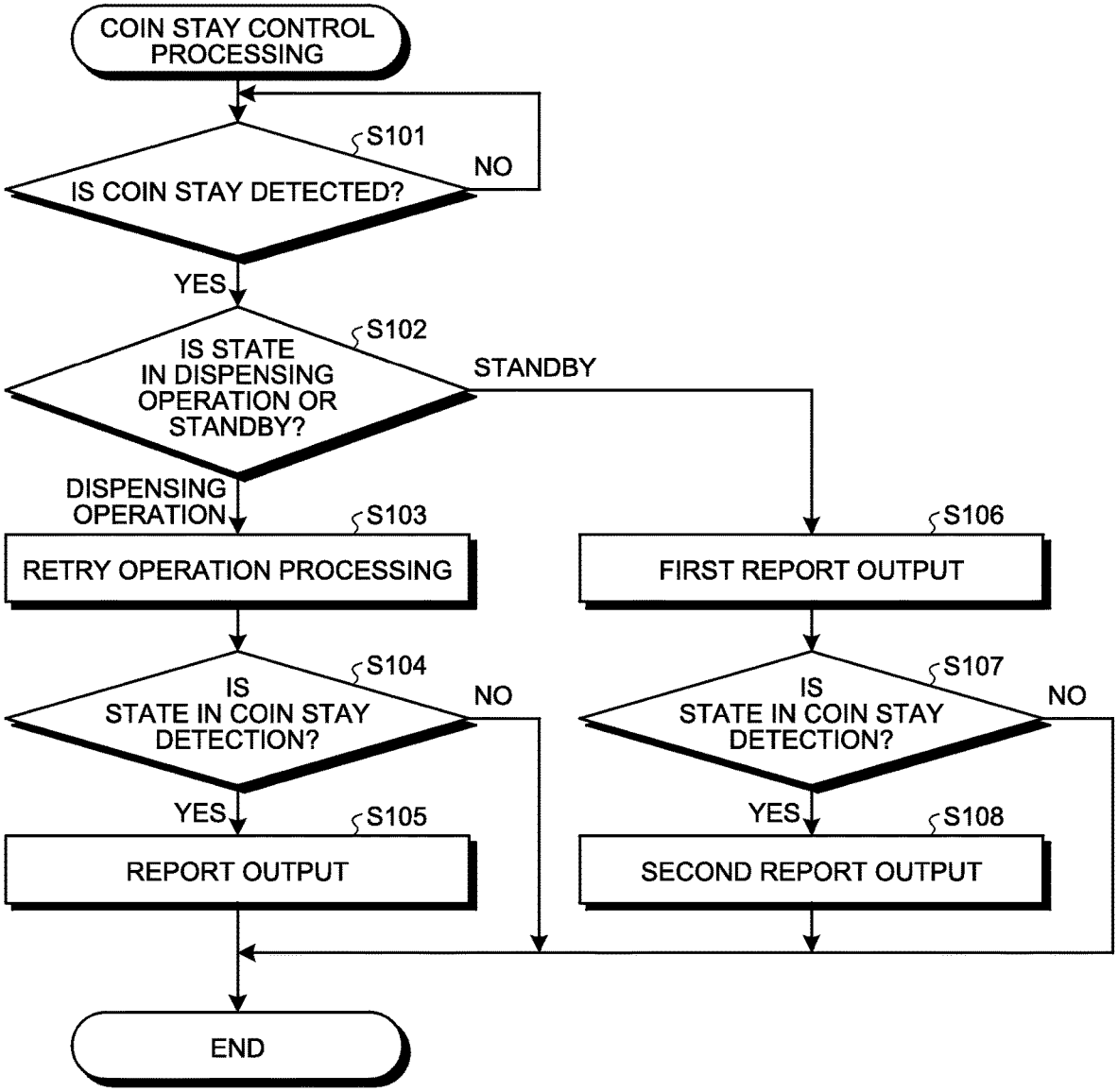
FIG. 8 is a flowchart illustrating a coin stay control processing procedure by the coin stay control unit.

With reference to a flowchart of FIG. 8, the following describes a coin stay control processing procedure by the coin stay control unit 32. As illustrated in FIG. 8, first the coin stay control unit 32 determines whether any of the coin stay detecting sensors 17 detects a coin stay on the shoot face 16*a* (Step S101). If no coin stay is detected (No at Step S101), the determination processing of this Step S101 is repeated. By contrast, if any coin stay is detected (Yes at Step S101), the coin stay control unit 32 determines whether the coin processing apparatus is in coin dispensing operation or in standby state (Step S102).

When the coin processing apparatus is in coin dispensing operation (coin dispensing operation at Step S102), the coin stay control unit 32 causes the conveying belt of the coin output conveying unit 15 to perform forward conveyance and backward conveyance to provide retry operation (Step S103).

The coin stay control unit 32, at the time of completing the retry operation, determines whether the coin stay detecting state is continued (step S104). When the coin stay detecting state is continued (Yes at Step S104), the coin stay control unit 32 performs report output indicating the coin stay in the coin output shoot unit 16 (coin stay abnormality) from the display unit 5 and/or the buzzer 14 (Step S105), and then ends the processing. This report output at Step S105 is specifically error reporting. By contrast, when the coin stay detecting state is canceled and not continued (No at Step S104), the processing is ended as it is.

In the case of a standby state (standby at Step S102), the coin stay control unit 32 performs report output from the display unit 5 and/or the buzzer 14 as a first report output indicating the coin stay in the coin output shoot unit 16 (Step S106). This first report is, for example, alarm reporting, or alarm processing as a preliminary stage of an error. Thereafter, the coin stay control unit 32, after the first report output, determines whether the coin stay detecting state has been continued when a predetermined time is elapsed (Step S107). When the coin stay detecting state has been continued (Yes at Step S107), the coin stay control unit 32 performs a second report output indicating the coin stay in the coin output shoot unit 16 from the display unit 5 and/or the buzzer 14 (Step 5108) and then ends the processing. The second report output at this step 5108 is specifically error reporting. In addition, when the coin stay detecting state is canceled and is not continued (No at Step S107), the processing is ended as it is.

Example of Coin Stay Control Processing During Dispensing Operation

Figure 9:
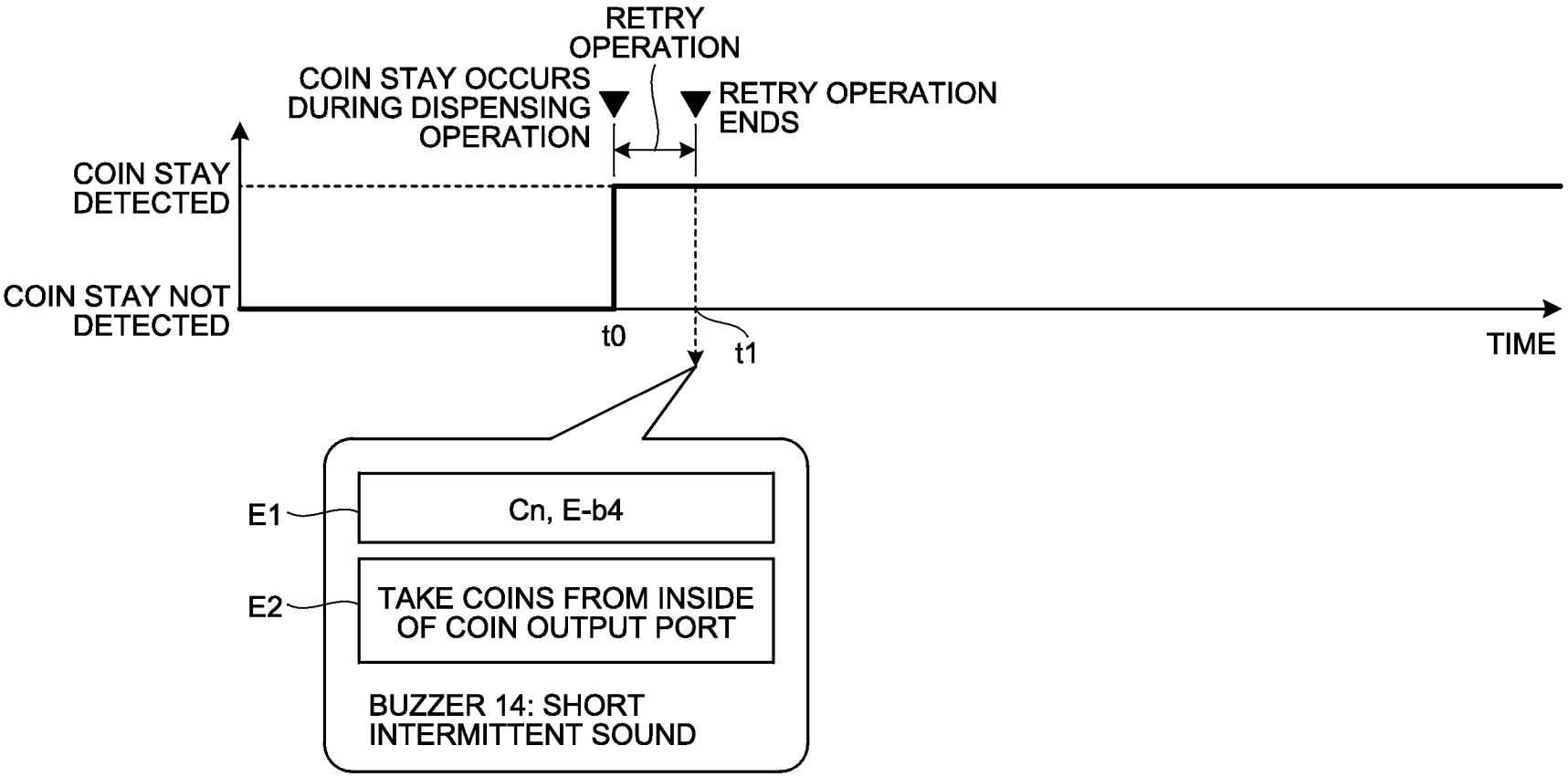
FIG. 9 is a timing chart illustrating the coin stay control processing including a specific example of report output during dispending operation.

FIG. 9 is a timing chart illustrating coin stay control processing including a specific example of report output during dispensing operation. As illustrated in FIG. 9, when a coin stay occurs at time tO during dispensing operation, a retry operation is performed thereafter. At time t1 when this retry operation is ended, if the coin stay state is continued, the coin stay control unit 32 displays an error code "Cn, E-b4" in the display area E1 of the display unit 5 and a message "TAKE COINS FROM INSIDE OF COIN OUTPUT PORT", which is a guide for error cancellation, in the display area E2. Furthermore, the coin stay control unit 32 outputs short intermittent sound from the buzzer 14. The above described report output is error reporting. For handling this error, remove the money including a coin that stays in the coin output shoot unit 16 and then, press the reset button of the operation unit 6 to perform reset processing. It should be noted that the retry operation is performed while coins are being dispensed because the remaining coins to be dispensed can stay, for example, between the coin output conveying unit 15 and the coin output shoot unit 16. The retry operation enables other coins staying on the shoot face 16*a* to slide by shooting the remaining coins.

Example of Coin Stay Control Processing During Standby

Figure 10:
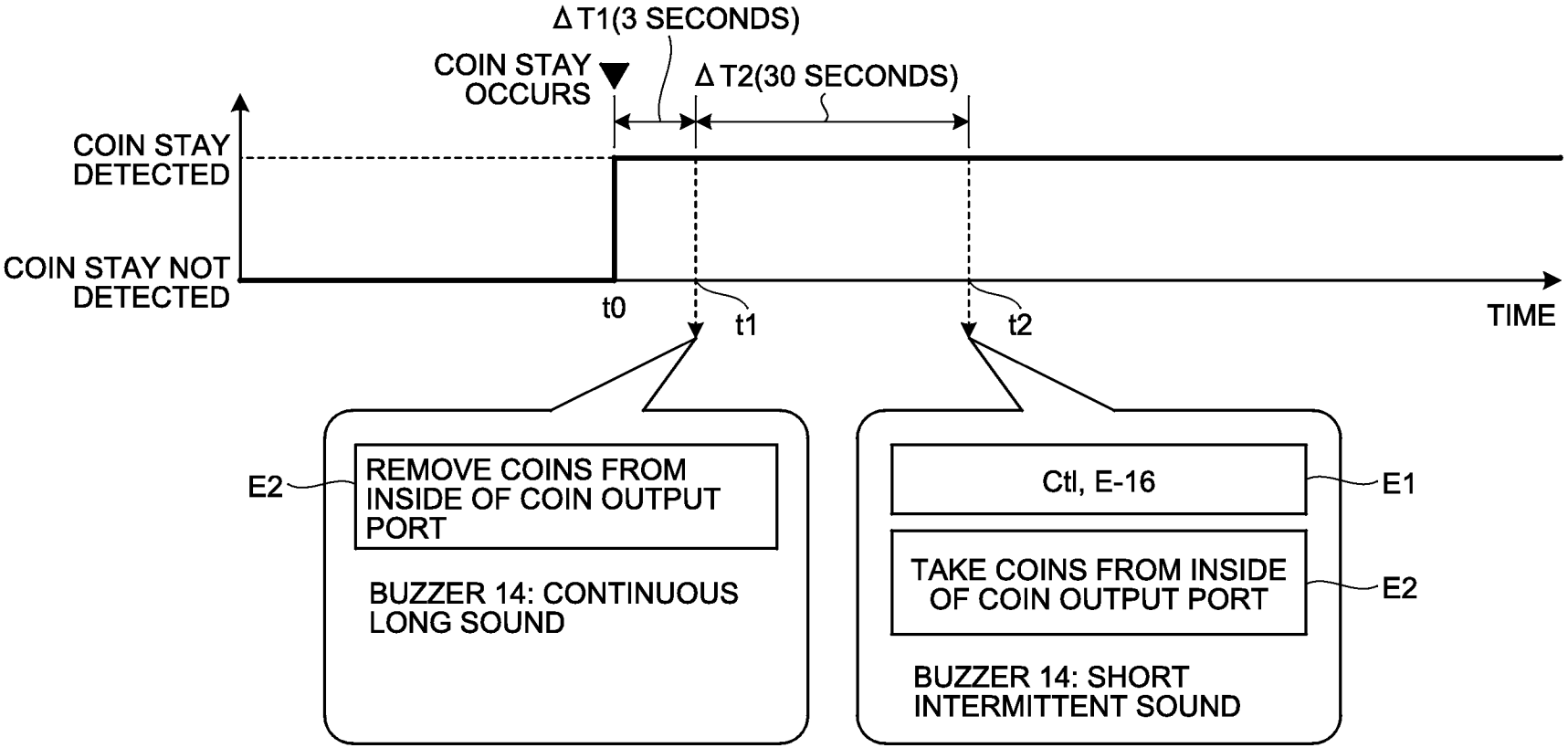
FIG. 10 is a timing chart illustrating the coin stay control processing including a specific example of report output during standby.

FIG. 10 is a timing chart illustrating coin stay control processing including a specific example of report output during standby. As illustrated in FIG. 10, if a coin stay occurs at the time t0 during standby, the coin stay control unit 32 performs alarm reporting, which is the first report output, at a predetermined elapsed time ΔT1 after the time t0 up to time t1, for example, when 3 seconds have elapsed. The predetermined elapsed time AT1 may be zero. This alarm reporting is not an error, and the coin stay control unit 32 displays no error code in the display area E1; but it displays the message "REMOVE COINS FROM INSIDE OF COIN OUTPUT PORT", which is a guide for error cancellation, in the display area E2. The coin stay control unit 32 outputs continuous long sound from the buzzer 14. For handling this alarm, what needs to be done is only removing money including coins staying in the coin output shoot unit 16. The removing money enables alarm reporting to be automatically canceled.

If the coin stay state continues for further predetermined time ΔT2 after the time t1, for example, for 30 seconds from the time t1 until time t2, the coin stay control unit 32 performs the second report output. The second report output displays an error code "Ctl, E-16" in the display area E1 of the display unit 5 and a message "TAKE COINS FROM INSIDE OF COIN OUTPUT PORT", which is the guide for error cancellation, in the display area E2. The coin stay control unit 32 outputs short intermittent sound from the buzzer 14. The above described report output is error reporting. For handling this error, first remove money including coins staying in the coin output shoot unit 16, and then press the reset button of the operation unit 6 to perform reset processing. It should be noted that the report output at the time t1 in FIG. 9 and the second report output at the time t2 in FIG. 10 are regarded as the same report output except that their error codes are different from each other. The disclosure is not limited to this, but report output having different content may be performed according to error content. Characters "Cn" in the error code in FIG. 9 represent the error of the coin processing apparatus 1 itself (the coin unit). Characters "Ctl" in the error code in FIG. 10 represent an error in a controller, for example, the controller 30.

For the above-described report output, both of the voice (buzzer) output and the display output are simultaneously performed, but either one of the report outputs alone may be performed. Furthermore, the reporting unit may be provided on the body of the host device that is connected to the coin processing apparatus 1 via the controller 30 instead of on the coin processing apparatus 1.

In the embodiment of the disclosure, the coin processing apparatus includes the coin stay detecting sensor 17 for detecting a coin stay on the shoot face 16*a* of the coin output shoot unit 16, and when the coin stay detecting sensor 17 detects the coin stay, the coin stay control unit 32 causes the reporting unit (the display unit 5 and the buzzer 14) to perform report output for the coin stay abnormality in the coin output shoot unit 16. This enables the embodiment of the disclosure to detect a coin stay in the coin output shoot unit during coin dispensing, and promptly recover the coin dispensing function from a failure caused by the coin stay so as to maintain the coin dispensing function in a stable manner.

Additional advantages and modifications will readily occur to those skilled in the art. Therefore, the disclosure in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A coin processing apparatus configured to:

cause a coin output conveyer to collectively convey coins taken out for each denomination from a plurality of coin containers where the coins are housed in the respective coin containers for each denomination; and dispense the conveyed coins through a coin output chute directly to a coin output port, the coin output chute being downwardly inclined so the coins are gravitationally conveyed to the coin output port and the coin output chute having a front side to contact the coins, the coin processing apparatus comprising:

a plurality of coin stay detecting sensors provided on the coin output chute in between the plurality of coin containers and the coin output port, the plurality of coin stay detecting sensors being configured to detect a coin stay on a chute face of the coin output chute on an upstream side of the coin output port, the coin output chute being directly connected to the coin output port, a first coin detecting sensor of the coin stay detecting sensors being provided on an upstream side of the coin output chute that is directly connected to the coin output port, a second coin detecting sensor of the plurality of coin stay detecting sensors being provided on a downstream side of the coin output chute, and a third detecting sensor of the plurality of coin stay detecting sensors being provided between the first detecting sensor and the second detecting sensor, the first detecting sensor, the second detecting sensor, and the third detecting sensor are each provided on a back side of the coin output chute, the plurality of coin stay detecting sensors being magnetic coil sensors;

an output configured to perform a report output for a coin stay abnormality; and a controller configured to:

cause the output to perform the report output for the coin stay abnormality in the coin output chute when the coin stay detecting sensors detect the coin stay on the chute face, when the coin stay detecting sensors detect the coin stay on the chute face during a dispensing operation, cause the coin output conveyer to perform a retry operation by a forward conveyance and a backward conveyance, and when a state of the coin stay on the chute face continues after an end of the retry operation, cause the output to perform the report output for the coin stay abnormality in the coin output chute.

2. The coin processing apparatus according to claim 1, wherein, when the coin stay detecting sensors detect the coin stay on the chute face during a standby, the controller causes the output to perform the report output for a first coin stay abnormality in the coin output chute, and when a state of the coin stay on the chute face continues from the report output for the first coin stay abnormality until a predetermined time is elapsed, the controller causes the output to perform the report output for a second coin stay abnormality in the coin output chute.

3. The coin processing apparatus according to claim 1, wherein the report output is at least one of voice output and display output.

4. The coin processing apparatus according to claim 1, wherein the output is provided on a host device that is connected to the coin processing apparatus through the controller.

5. The coin processing apparatus according to claim 1, wherein the coin output chute includes the chute face and a back face on a back side of the chute face, the chute face of the coin output chute tilts downwards, and the coin stay detecting sensors are provided on the back face of the coin output chute.

* * * * *